United States Patent [19]

Creagan et al.

[11] Patent Number: 4,532,008

[45] Date of Patent: Jul. 30, 1985

[54] HORIZONTAL TWIN WIRE MACHINE

[75] Inventors: Richard W. Creagan, Kirkland, Canada; Thomas W. Patell, Mannsville, N.Y.

[73] Assignee: The Black Clawson Company, Middletown, Ohio

[21] Appl. No.: 516,069

[22] Filed: Jul. 22, 1983

[51] Int. Cl.[3] ..... D21F 1/40; D21F 1/00

[52] U.S. Cl. ..... 162/203; 162/208; 162/211; 162/301; 162/303; 162/348

[58] Field of Search ..... 162/348, 300, 301, 303, 162/203, 205, 208, 211

[56] References Cited

U.S. PATENT DOCUMENTS

| | | | |
|---|---|---|---|
| 2,881,676 | 4/1959 | Thomas | 162/301 |
| 3,578,561 | 5/1971 | McCarrick et al. | 162/301 |
| 3,772,145 | 11/1973 | Notbohm | 162/301 |
| 3,847,731 | 11/1974 | Arledter | 162/301 |
| 3,994,774 | 11/1976 | Halme et al. | 162/301 |
| 4,125,428 | 11/1978 | Phelps | 162/301 |
| 4,154,645 | 5/1979 | Kankaanpaa | 162/301 |
| 4,176,005 | 11/1979 | Bubik et al. | 162/300 |
| 4,417,950 | 11/1983 | Bubik et al. | 162/300 |

FOREIGN PATENT DOCUMENTS

| | | | |
|---|---|---|---|
| 817630 | 7/1969 | Canada | 162/301 |
| 827662 | 5/1981 | U.S.S.R. | 162/300 |

OTHER PUBLICATIONS

Bulletin Entitled "Top Flyte Former"–Sep. 1984, Published by The Black Clawson Company.

Pulp & Paper, Sep. 1982, pp. 130–135.

Pulp & Paper, Jul. 1984, pp. 114–118.

*Primary Examiner*—S. Leon Bashore

*Assistant Examiner*—K. M. Hastings

*Attorney, Agent, or Firm*—Biebel, French & Nauman

[57] ABSTRACT

In a horizontal twin-wire paper machine, the paper sheet is initially formed in a wedge-shaped zone defined by generally horizontal runs of the primary wire and top wire which are brought into converging relation by cooperating sets of deflectors which support both runs against relative displacement by the stock therebetween and thereby cause liquid to be expressed through both of the wire runs throughout the wedge zone. The converged wires with the newly formed sheet therebetween then travel partially around one or more imperforate forming rolls, after which the top wire is guided away, and the sheet continues its travel on the primary wire. A major feature is the ease and simplicity with which the structure for supporting the top wire and the elements for defining the wedge zone can be added to an existing Fourdrinier machine to convert it to a twin-wire machine.

14 Claims, 6 Drawing Figures

30
31b
81
85
80
52
31a
50
22'
22
70
71
15
91
90
95
12
20
11

HORIZONTAL TWIN WIRE MACHINE

BACKGROUND OF THE INVENTION

This invention relates to twin paper making machines wherein two opposed runs of the forming wires are guided in generally horizontally traveling and converging relation to define a forming zone wherein the paper sheet is formed by extrusion of the liquid through both wires as they converge into essentially parallel relation with the sheet therebetween, and wherein the upper wire thereafter separates to leave the sheet exposed on the lower wire. This is basically a very old concept in paper making machines, as illustrated by U.S. Pat. No. 49,884, Jones of 1865 and U.S. Pat. No. 667,902, Case et al of 1901. A more recent patent, illustrating techniques which had some commercial success in the 1950's, is U.S. Pat. No. 2,821,120, Thomas et al of 1958.

In more recent years, there has been a trend toward vertical twin wire paper machines, wherein a pair of runs of the forming wires are guided in generally vertically traveling and converging relation to define the forming zone wherein the paper is formed, for example as shown in U.S. Pat. No. 3,597,315, Notbohm et al of 1971 and U.S. Pat. No. 4,125,428, Phelps of 1978. It is the primary object of the present invention to provide a horizontal twin wire paper machine and horizontal twin wire paper machine techniques which incorporate as many as possible of the advantageous features of such vertical twin wire machines.

SUMMARY OF THE INVENTION

In the development of the present invention, it has been noted that although the prior art of horizontal twin wire paper machines generally provides for convergence of superimposed runs of the upper and lower forming wires, the prior art has not suggested either the desirability of creating a "wedge zone" wherein liquid is forcibly extruded through both wires, or the provision of means by which such a wedge zone can be created. Rather, one or both of the converging wire runs have been unsupported, except by their own tension, over at least the major portion of the distance during which the drainage of free water and sheet formation take place.

In accordance with the invention, the converging wire runs which define the forming zone are so supported as to define a wedge zone which is at all times filled with stock, and the wire runs which define that wedge zone are supported and maintained against relative displacement by that stock in order to cause the liquid component of this stock to be rapidly expressed through both of the wires in such manner and at such rate that the technical operation of sheet formation will be carried out more rapidly and more effectively, and will give a better product, than has heretofore been possible to achieve on a horizontal paper machine of either the single wire or twin wire type.

In a typical paper machine in accordance with the principles of the invention, the major portion of the machine, which supports the primary forming wire, is the same as in a conventional Fourdrinier machine except that two or three forming rolls are mounted between the breast and couch rolls. The top wire is supported by the appropriate number of guide rolls above the primary wire, and one of these guide rolls is so located that a run of the top wire normally extends straight therefrom into converging relation with the primary wire toward the first forming roll.

A second forming roll is located on the opposite side of both wires from the first forming roll to receive both wires from the first forming roll after they have partially wrapped the surface of the first forming roll with the newly formed sheet therebetween, and thereby force the expression of liquid through the outer of the wires. Additional rolls, one of which may be a third forming roll, lead the wires and sheet into wrapping engagement with the second forming roll for additional forced expression of liquid through the outer wire, after which the top wire is removed and the sheet proceeds on the primary wire toward the couch roll.

An important feature of the invention is that the courses of the converging wire runs which define the wedge zone are so controlled that their angle of convergence is sufficiently small that over at least the major portion of the length of the wedge zone, its height is less than the depth of the layer of stock which reaches this wedge zone on the primary wire. In addition, both runs are supported, by deflectors or other suitable guide means, along both sides of the wedge zone so that they are held as nearly as possible to a predetermined convergence such that free liquid in the stock therebetween is forcibly expressed through both wires at controlled rates.

The deflectors or other guide means along the outer sides of the wedge zone are mounted in offset relation lengthwise of the machine so that the upper wire is unsupported in the area directly above a supporting member for the lower wire, and vice versa. In addition, these guide means for the upper wire are preferably mounted for vertical adjustment, so that the angle of convergence of the wire runs which define the wedge zone can be changed in accordance with desired operating conditions.

One result of these offset guide means is that there is a pressure zone inside the wedge zone opposite each guide member, and since the pressure is applied alternately from below and above the wedge zone, the fibers within the zone are maintained properly dispersed throughout the width of the zone while they are also forced rapidly into the desired contact with each other which completes "formation" of the sheet, by which is meant the elimination of free liquid from between the wires and the resultant establishment of fiber to fiber contact throughout the mat between the wires. In addition, the spaces above and below the wedge zone are open to the surrounding atmosphere and are therefore at ambient pressure so that the expression of the liquid is effected by the pressure between the two wires in the wedge zone and not by suction applied from outside the wedge zone.

The forming rolls which follow the wedge zone are arranged alternately on opposite sides of the two wires so that as soon as formation of the sheet is completed between the wires, the sandwich of wire-sheet-wire partially wraps the surfaces of at least two forming rolls, with the wire which contacts the first roll being on the outside when the sandwich wraps the second roll, thereby causing further forced expression of liquid first through one wire and then through the other.

A significant advantage of the present invention is that it makes possible the production of paper sheet on a horizontal twin wire machine which has substantially all the advantages of paper produced on a vertical twin wire machine, particularly from the standpoint of freedom from "two sidedness" which normally characterizes paper formed on a horizontally traveling wire. This highly advantageous property of the product of machines of the invention is believed to be primarily the result of the alternating pressure effects in the wedge zone, and also around the forming rolls.

An important practical advantage of the invention is that the equipment necessary to convert a conventional Fourdrinier machine into a twin wire machine in accordance with the invention is relatively simple, and can be added to a conventional Fourdrinier machine with relatively little modification of the existing structure.

One technological point which should be noted is that in the practice of the invention, it has been determined that optimum results are obtained when the consistency of the stock stock carried by the primary wire into the wedge zone is in the range of approximately 0.9 to 1.5% solids content as it enters the wedge zone. This condition is readily established when the invention is combined with an existing Fourdrinier machine by providing a sufficient number of conventional foil boxes between the breast roll and the wedge zone to retard the free drainage through the primary wire ahead of the wedge zone. In building a new forming section in accordance with the invention, however, the headbox can be located closer to the forming zone and provided with stock of the desired relatively higher consistency which is delivered to the wire immediately ahead of the wedge zone, thereby substantially reducing the overall length of the forming section, as well as its cost.

BRIEF DESCRIPTIN OF THE DRAWINGS

DESCRIPTION OF THE PREFERRED EMBODIMENTS

Figure 1:
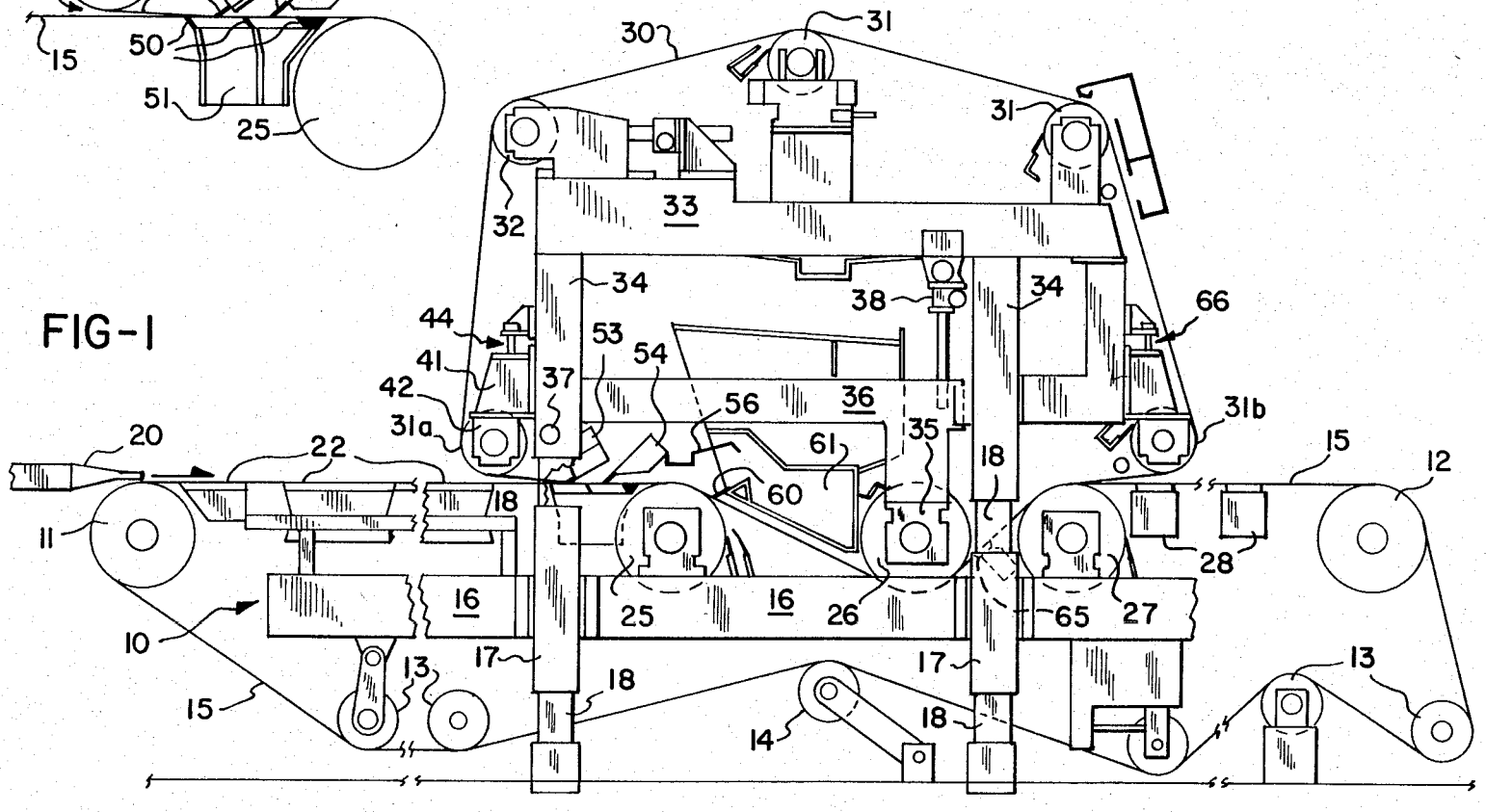
FIG. 1 is a side elevation illustrating somewhat diagrammatically one form of horizontal twin wire paper machine in accordance with the invention.

FIG. 1 shows the basic elements of the paper machine, including frame means designated generally as 10 which support the breast roll 11, suction couch roll 12, and the usual wire return rolls 13 and tensioning roll 14 for supporting the primary forming wire 15. The frame is of conventional construction and includes side rails 16, front columns 17 and blocks 18 which are removable for wire stringing purposes. A headbox 20 is mounted on the frame in the usual manner to deliver a flow of stock onto the top of wire 15 at the breast roll 11 for travel on the wire over a series of foil boxes 22 mounted on the side rails 16, after which the wire travels over a first forming roll 25, then under a second forming roll 26, and then over a third forming roll 27 and a plurality of suction boxes 28 to the couch roll 12.

The second or top forming wire 30 is supported above the frame 10 by a series of guide rolls 31 and a tensioning roll 32 carried by additional frame means 33 including cantilever beams 34. The bearing housings 35 for supporting the second forming roll 26 inside the loop of the wire 30 depend from a supplemental frame 36 which has one end pivoted at 37 to the frame means 33, and the other end of frame 36 is supported for vertical adjustment by a motor operated jack 38 mounted on the frame 33. The top wire 30 therefore travels under the second forming roll 26 and is thus caused to wrap parts of the upper surfaces of both of the forming rolls 25 and 27 in addition to the undersurface of forming roll 26.

The guide roll 31*a* immediately upstream from the forming roll 26 is located relatively closely above the primary wire so that the run of the top wire from that roll to the first forming roll 25 converges with the run of the primary wire immediately beneath it at a very small included angle, such that over at least the major portion of the length of the converging wire runs, the height of the resulting wedge zone 40 between them is less than the thickness or depth of the stock layer on the wire 15 which enters this wedge zone. Accurate control of the angle of convergence of these wire runs is facilitated by a vertically adjustable mounting for the roll 31*a*, the support 41 for the bearing housings 42 for roll 31*a* having a manually adjustable mounting 44 from the adjacent beam 34.

In addition to this initial establishment and control of the wire runs which define the wedge zone, special provision is made in accordance with the invention for supporting the wires above and below the wedge zone against relative displacement by the stock therebetween in order to put that stock under maintained pressure which causes it to be expressed through both wires more rapidly than it would otherwise drain freely and thereby accelerates formation of the sheet before it reaches the first forming roll 25.

Figure 2:
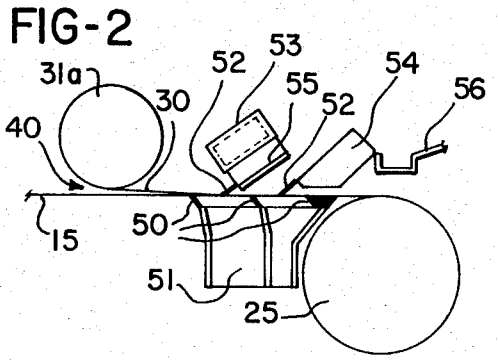
FIG. 2 is an enlarged fragment of FIG. 1.

In the embodiment of the invention shown in FIGS. 1 and 2, the desired control of the wedge zone and forced drainage is provided by a plurality of deflectors which support both of the converging wire runs in maintained converging relation. More specifically, the run of the primary wire 15 immediately upstream from the first forming roll 25 is supported by three deflectors 50 which are mounted in fixed positions on the machine frame below the wire 15 by means of an open box frame 51. Satisfactory results have been obtained in a test installation with a distance of one foot from the leading edge of each deflector 50 to the next adjacent deflector, and it is important that the last deflector be as close as is practically possible to the point where the wire is tangent to the roll 25, in order to minimize the amount of liquid on the under side of the wire as it engages the roll.

Two deflectors 52 are provided for the top wire 30, and they are mounted on the supplemental frame 36 which carries the forming roll 26 so that they can also be swung up with the roll 26 to facilitate wire changing. The deflectors 52 are located opposite the spaces between adjacent primary wire deflectors 50, and preferably the mounting 53 for at least the first top wire deflector 52 on the frame 36 provides for adjustment, both vertical and horizontal, of the associated deflector 52 to establish the desired line of travel for the run of the top wire from the guide roll 31*a* to the leading deflector 52 with respect to the corresponding run of the primary wire 15. The adjustable mounting 53 may, for example, be of the construction shown in U.S. Pat. No. 3,578,561, McCarrick et al of 1971, and a similar adjustable mounting 54 may be provided for the other deflector 52.

As one operating example, in the initial set-up of the machine, the deflectors 52 should be adjusted so that they just maintain contact with the wire 30 when there is no stock on the machine and the wire 30 is following its natural straight course tangent to both the guide roll 31*a* and the forming roll 25. Then when the machine is in operation and the wedge zone is filled with stock, each wire run will be restrained against vertical deflection as it passes each of its own deflectors, but the portion of the other wire run opposite each deflector for the first wire will be unsupported except by its tension, so that it can assume whatever catenary position is necessary to accommodate the stock between itself and the deflector for the other wire. This action will take place alternately for each wire until the last deflector is passed and the wires and sheet form a sandwich as they wrap the roll 25.

Test results indicate that it is desirable that the stock should be of a consistency of in the range of approximately 0.9 to 1.5% when it enters the wedge zone 40. When an existing Fourdrinier machine is converted to twin wire operation in accordance with the invention, the most convenient location for the top wire is at approximately the middle portion of the existing machine, with the forming rolls 25 and 27 mounted on the side rails 16. The foil boxes 22 are then needed to retard initial drainage sufficiently so that stock of the conventional initial consistency of 0.6 to 0.8% solids has dewatered to the desired higher consistency when it reaches the wedge zone. When the invention is applied to a new installation, the top wire can be located closer to the breast roll, and the machine can be operated with the stock of heavier consistency as it is delivered to the wire.

In a typical operation with a machine of the configuration shown in FIGS. 1 and 2, the thickness or depth of the stock on the primary wire as it approaches the forming zone 40 will be slightly less than the vertical distance between the wire and the bottom of guide roll 31*a*, but the stock should come into contact with the top wire 30 near the mouth of the wedge zone. Then as it continues to travel with the converging wire runs, the pressure within the wedge zone produced by the combined action of each successive deflector and the tension of the other wire opposite that deflector will force accelerated expression of the liquid through both wires. This action may be increased by adjustment of the top wire deflectors downwardly towards and into overlapping relation with the line connecting the edges of the lower deflectors 50, and thereby accentuating the S-pattern path of the two wire runs.

Liquid draining through the primary wire 15 will be scraped off the underside of the wire by the deflectors 52 and fall by gravity into the usual white water pit. Water forced through the top wire will have high momentum which has been imparted to it by the wire speed and will travel up the chute 55 in the mounting 53 for the first deflector 52 and up the top of the mounting 53 for the second deflector 52 into a save-all pan 56 from which it is removed at the side of the machine. Since as already noted, the spaces above and below the wedge zone are open to the ambient pressure of the surrounding atmosphere, with no suction box or other suction means in either space, it is the compression of the forming zone by the converging wire runs which causes expression of liquid through each of the exposed and unsupported areas of those runs between their supporting deflectors.

Since both wires with the newly formed sheet therebetween are then forced to wrap a part of the surface of the first forming roll 25, the top wire exerts pressure on the sheet forcing additional liquid to be expressed to the inner surface of this wire, from which it is removed by a deflector 60 into a further save-all pan 61. Then when the sandwich of two wires and sheet reaches the forming roll 26, it is forced to wrap a portion of its surface in order to travel back up to the forming roll 27.

During the interval that the sandwich is wrapping the roll 26, the tension on the primary wire 15 will exert pressure on the new sheet and thereby force expression of additional liquid, which will either be thrown off by centrifugal force or be removed by a scraper 65 mounted on the frame to extend across the width of the machine between the forming rolls 26 and 27. The first guide roll 31*b* for the top wire located downstream from the forming roll 27 has a vertically adjustable mounting 66 by which it can be set at the appropriate height to cause the top wire 30 to separate from the sandwich across the top of the forming roll 27, from which the sheet travels to the couch roll on top of the wire 15 in the usual way.

The length of the wedge zone 40 and the number and settings of the deflectors 50 and 52 can be predetermined in accordance with the desired rate of dewatering within the wedge zone in order to achieve gentle drainage of all free water for the sheet between the wire before it reaches the first forming roll 25. For example, if the stock has a consistency of 1.5% at the entrance to the wedge zone and it is desired to increase that consistency to 4.5% at the forming roll 25, approximately $\frac{2}{3}$ of the liquid must be eliminated during passage of the stock through the wedge zone. This means that the thickness of the incipient sheet between the wires must reduce by $\frac{2}{3}$ during its passage through the wedge zone, and the vertical dimensions of the wedge zone should therefore correspondingly reduce over the same distance.

Such control of the configuration of the wedge zone can be effected by adjustment of one or more of the top wire deflectors 52, as already noted, and it may also be desirable to raise or lower the guide roll 31*a* at the same time. The specific dimensions required for a given forming operation can be readily calculated from typical dewatering rate figures as noted above and the desired basis weight of the finished sheet, but as an example of dimensions which have proved to be appropriate in a test installation to produce sheet having a basis weight of 30 pounds, the length of the run of top wire 30 from roll 31*a* to its first deflector 52 was 21.5 inches, the height of the line of tangency of wire 30 to the roll 31*a* above wire 15 was approximately $\frac{3}{8}$ inch, the depth of the layer of stock on wire 15 was approximately $\frac{1}{4}$ inch, and the initial angle between the converging wire runs was approximately 1.0° with no stock on the machine. Under these conditions, the consistency of the sheet increased from approximately 1.5% at the mouth of the wedge zone to approximately 4% at the first forming roll 25, approximately 12% at the third forming roll 27 and approximately 20% on leaving the couch roll 12.

An important practical advantage of the invention is the comparative simplicity and ease of modifying an existing Fourdrinier machine to convert it into a twin wire machine. All that is required for this purpose is to remove the table rolls and/or other supports for the primary wire between the foil boxes and the suction boxes on an existing machine to provide space in which to mount the forming rolls 25 and 27, and then to add the frame structure necessary for supporting the top wire. The same practical advantage applies to the various modifications of the invention described hereinafter.

Figure 3:
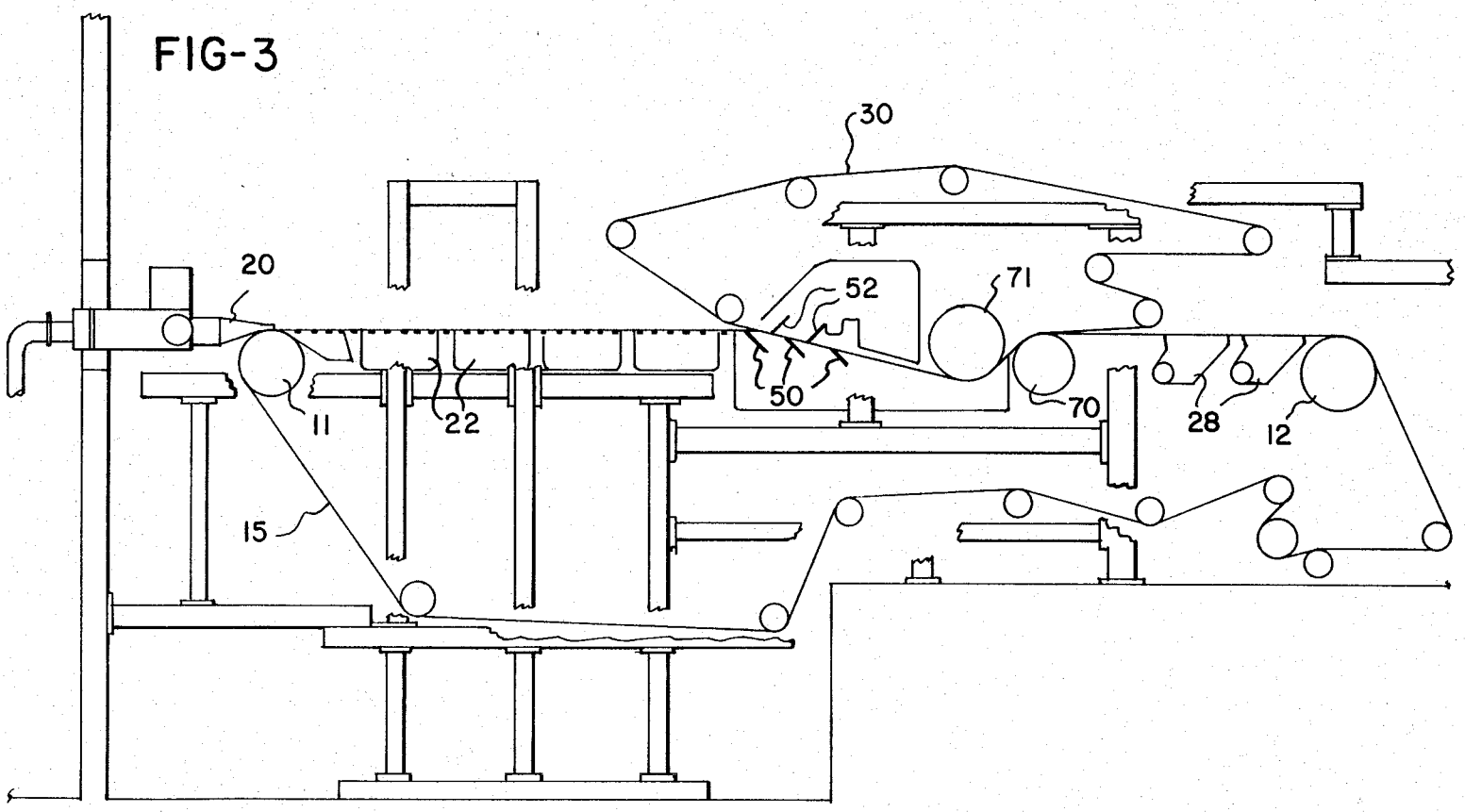
FIG. 3 is a diagrammatic view illustrating an alternative embodiment of the invention.

In the embodiment of the invention shown in FIG. 3, many of the parts are in the same relative positions as in the machine of FIG. 1 and are therefore given the same reference characters. The primary difference between the two forms is that the machine in FIG. 3 includes only two forming rolls, and the positions of those rolls are reversed with respect to the machine in FIG. 1.

More specifically, the first forming roll 70 is located within the loop of the top wire and is of larger diameter than the second forming roll 71, which is located within the loop of the primary forming wire. As a result, the two wire runs which define the wedge zone wrap the underside of the first forming roll 70 and the upper side of the second forming roll 71. In addition, since convenience of construction calls for the axes of these two rolls to be in or near the same horizontal plane, the primary wire 15 travels downwardly thereto from the level of the foil boxes 22, and its supporting deflectors 50 are set so that the wire breaks around each of them through a small angle such that the sum of these angles provides the desired course for the converged wire runs to the forming roll 70. The opposed run of the top wire 30 similarly travels downwardly at a greater angle to the horizontal than in the form of FIG. 1. Otherwise, the description of the machine shown in FIG. 1 and its mode of operation is equally applicable to FIG. 2.

Figures 4, 5, 6:
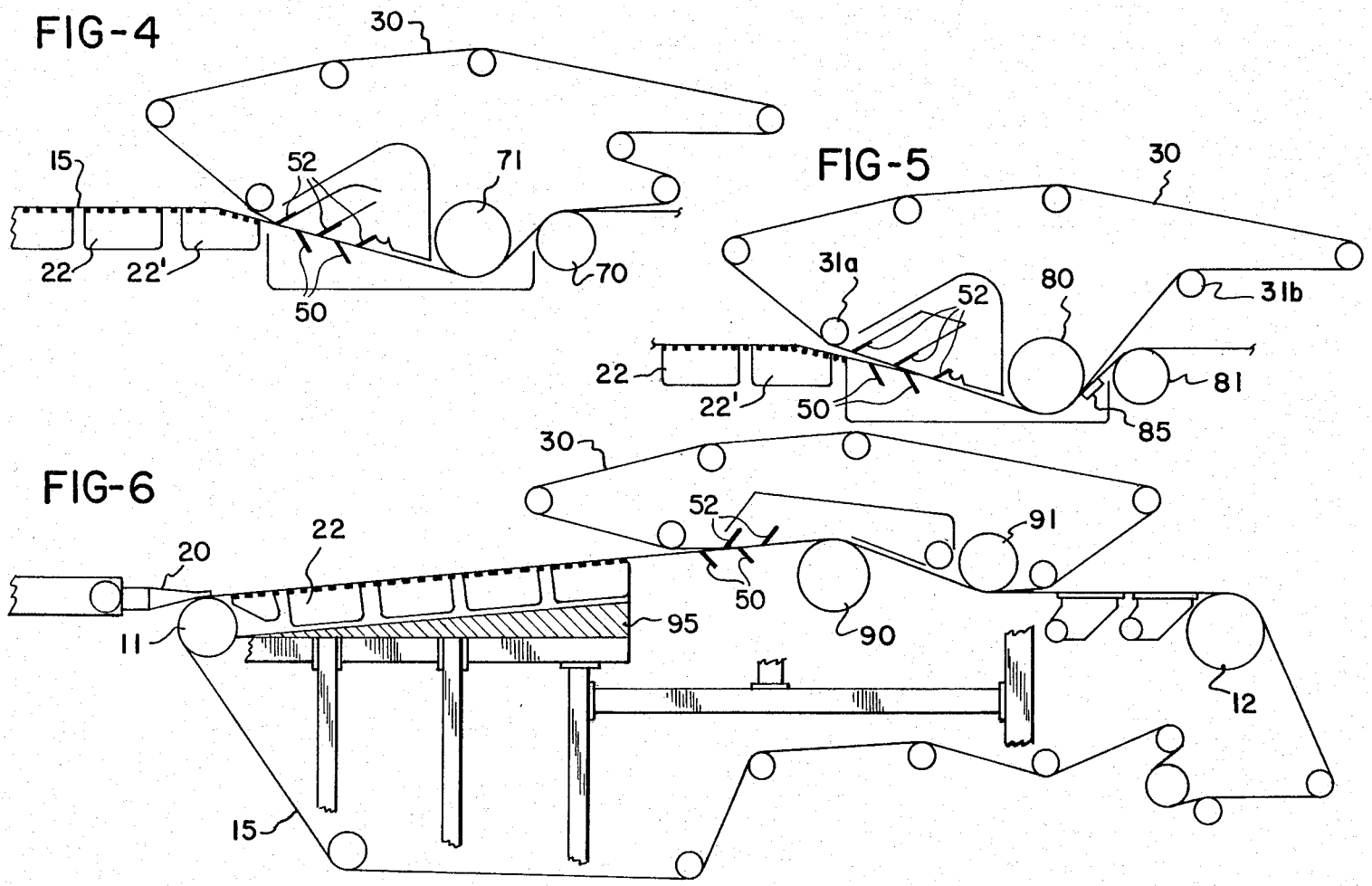
FIGS. 4–6 are views similar to FIG. 3 showing other embodiments of the invention.

FIG. 4 shows a slightly modified version of the embodiment of the invention shown in FIG. 3, with the main difference being that that the last foil box 22' is constructed with its upper surface curved downwardly so that the run of the primary wire 15 from this foil box to the first forming roll 70 is slightly downwardly inclined from the horizontal. In addition, FIG. 4 shows a variation of the deflector arrangement in that there are two deflectors 50 supporting the run of the primary wire which defines the lower half of the wedge zone, and they are opposed by three deflectors 52 for the top wire 30. Otherwise, the description of FIGS. 1–3 applies also to FIG. 4.

The form of the invention shown in FIG. 5 is essentially the same as in FIG. 4, with the only difference being that the guide roll **31*b* which causes the top wire 30 to separate from the sheet on the primary wire 15 is so located that this separation occurs between the forming rolls 80 and 81. Preferably, a suction box 85 is located under the area of the primary wire 15 where separation of the top wire occurs, thereby assuring that the sheet will remain on the primary wire and also effecting some further dewatering of the sheet immediately in advance of contact between the primary wire and the surface of the forming roll 81**.

FIG. 6 shows a further embodiment of the invention wherein the primary wire 15 is caused to follow a slightly upwardly inclined path from the breast roll 11 to the first forming roll 90, from which both wires follow a downwardly inclined path to and partially around the forming roll 91 which is located within the loop of the top wire. The element 95 in FIG. 6 represents one of the wedge shaped shin members used to mount the foil boxes 22 in the desired upwardly inclined relation on the side rails 16. It is to be understood that the more detailed showing in FIG. 1 is adaptable to each of the modified embodiments of the invention shown in FIGS. 3–6.

While the method herein described, and the forms of apparatus for carrying this method into effect, constitute preferred embodiments of this invention, it is to be understood that the invention is not limited to this precise method and apparatus, and that changes may be made in either without departing from the scope of the invention, which is defined in the appended claims.

What is claimed is:

1. In apparatus for forming paper, including a breast roll, a couch roll and associated wire guide rolls supporting a primary endless forming wire, the combination of:

(a) a forming roll positioned to receive a generally horizontal run of said forming wire from said breast roll, (b) headbox means adjacent said breast roll for delivering a flow of paper making stock to said wire for drainage therethrough to form a paper sheet thereon while traveling thereon toward said forming roll, (c) a plurality of guide rolls supporting a second endless forming wire above said primary wire, (d) roll means positioned to guide a run of said second wire from one of said guide rolls into converging relation with said primary wire run on the surface of said forming roll with said convering wire runs defining a wedge zone therebetween and then wrapping a portion of the surface of said forming roll, (e) means maintaining said one wire guide roll in such vertically spaced relation with said primary wire run that a substantial length of said wedge zone has a height less than the depth of said stock flow on said primary wire run, (f) at least one primary wire guiding member positioned below and in supporting contact with said primary wire run along said wedge zone, (g) at least one upper wire guiding member located within the loop of said second wire in supporting contact with said second wire run along said wedge zone and in offset relation lengthwise of said wedge zone with each said primary wire guiding member, (h) each said wire guiding member being proportioned for contact with a minor area of said wire run supported thereby to expose a major unsupported area of each said run to the space on the opposite side of said run from said wedge zone for passage of liquid therethrough into said space, (i) means between said headbox means and said wedge zone for controlling drainage through said primary wire to prevent formation of a sheet on said primary wire upstream from said wedge zone, (j) means mounting each said upper wire guiding member in predetermined vertically spaced relation with each said primary wire guiding member wherein said wire guiding members support and maintain both of said wire runs against relative displacement by the stock therebetween in said wedge zone and thereby cause liquid to be expressed through said unsupported exposed areas of both of said wires throughout said wedge zone and cause formation of a paper sheet between said wires, (k) said wedge zone being devoid of means for applying suction to either of said wire runs whereby said expression of liquid is effected by the progressive compression of said wedge zone by said converging wire runs, (l) means within the loop of said second wire for receiving and removing liquid expressed therethrough from said wedge zone, and (m) means located downstream from said forming roll in position to guide said second wire away from said primary wire and thereby to leave said newly formed sheet on said primary wire for travel thereon to said couch roll.

2. Apparatus as defined in claim 1, further comprising means for effecting relative vertical adjustment of said wire guiding members above and below said wedge zone to alter the shape of said wedge zone.

3. In apparatus for forming paper, including a breast roll, a couch roll and associated wire guide rolls supporting a primary endless forming wire, the combination of:

(a) a forming roll positioned to receive a generally horizontal run of said forming wire from said breast roll, (b) headbox means adjacent said breast roll for delivering a flow of paper making stock to said wire for drainage therethrough to form a paper sheet thereon while traveling thereon toward said forming roll, (c) a plurality of guide rolls supporting a second endless forming wire above said primary wire, (d) roll means positioned to guide a run of said second wire from one of said guide rolls into converging relation with said primary wire run on the surface of said forming roll with said converging wire runs defining a wedge zone therebetween and then wrapping a portion of the surface of said forming roll, (e) means maintaining said one wire guide roll in such vertically spaced relation with said primary wire run that a substantial length of said wedge zone has a height less than the depth of said stock flow on said Primary wire run, (f) at least one wire guide deflector positioned below and presenting an upper edge in supporting contact with a minor area of said primary wire run below said wedge zone, (g) at least one wire guiding deflector located within the loop of said second wire along said wedge zone and presenting a lower edge in supporting contact with a minor area of said second wire run and in offset relation lengthwise of said wire runs with each said wire deflector below said primary wire run, (h) means between said headbox means and said wedge zone for controlling drainage through said primary wire to prevent formation of a sheet on said primary wire upstream from said wedge zone, (i) means mounting each said upper wire deflector in predetermined vertically spaced relation with each said primary wire deflector wherein said deflectors support and maintain both of said wire runs against relative displacement by the stock therebetween in said wedge zone, (j) the number and spacing of said deflectors being such that a major portion of each of said wire runs is unsupported and exposed to the space on the opposite side thereof from said wedge zone for expression of liquid therethrough into said space and formation of a paper sheet between said wire runs, (k) said wedge zone being devoid of means for applying suction to either of said wire runs whereby said expression of liquid is effected by progressive compression of said wedge by said converging wire runs, (l) means within the loop of said secoud wire for receiving and removing liquid expressed therethrough from said forming zone, and (m) means located downstream from said forming roll in position to guide said second wire away from said primary wire and thereby to leave said newly formed sheet on said primary wire for travel thereon to said couch roll.

4. Apparatus as defined in claim 1 wherein said forming roll is an imperforate roll, and further comprising means for maintaining both of said wires under tension causing liquid to be expressed through the outer of said wire s as said wires with the sheet therebetween wrap said forming roll.

5. Apparatus as defined in claim 3, further comprising means for effecting vertical adjustment of at leat one said upper wire deflector to alter the shape of said wedge zone.

6. Apparatus as defined in claim 1, further comprising means for effecting vertical adjustment of said one guide roll to alter the vertical dimension of the upstream end of said wedge zone.

7. Apparatus as defined in claim 1 wherein said forming roll is positioned within the loop of said primary wire and said wires wrap the upper surface of said forming roll.

8. Apparatus as defined in claim 3, wherein said forming roll is an imperforate roll positioned within the loop of said primary wire to cause said wires to wrap a portion of the upper surface thereof, and wherein one of said first deflectors is positioned in close proximity to the junction of said primary wire with said forming roll to minimize the amount of water on the under side of the primary wire as it engages the surface of said forming roll.

9. Apparatus as defined in claim 1 wherein said drainage control means (i) comprises foil box means positioned below said primary wire downstream from said breast roll to effect controlled dewatering of the stock on said primary wire prior to its entry into said wedge zone.

10. Apparatus as defined in claim 1 wherein said roll means comprises a second forming roll located on the opposite side of said wires from said first named forming roll and positioned to receive said wires with the sheet therebetween in wrapping relation with a portion of the surface thereof, and further comprising means for maintaining both of said wires under tension causing liquid to be expressed through the outer of said wires as said wires with the sheet therebetween wrap each of said forming rolls.

11. Apparatus as defined in claim 10 wherein said first named forming roll is positioned within the loop of said primary wire, and said second forming roll is positioned within the loop of said second wire.

12. Apparatus as defined in claim 10, wherein both of said forming rolls are imperforate, and wherein one of said first deflectors is positioned in close proximity to the junction of said primary wire with said first named forming roll to minimize the amount of water on the underside of said primary wire as it engages the surface of said forming roll.

13. The process of forming a paper sheet on a primary endless wire in combination with an endless top wire which comprises the steps of:

a. delivering dilute paper making stock to a substantially horizontal run of said primary wire, b. guiding a run of said top wire into converging relation with said primary wire run at a small angle to form a wedge zone between said runs having a mouth at the upstream end thereof, c. guiding said converged wires into wrapping engaging with a forming roll at the downstream end of said wedge zone, d. establishing the vertical dimension between said runs adjacent the mouth of said forming zone at a value less than the depth of the stock on said primary wire run at the mouth of said forming zone, e. controlling drainage through said primary wire upstream from said wedge zone to prevent formation of a sheet on said primary wire in advance of said wedge zone, f. applying positive pressure to at least one minor area of said primary wire from below and to at least one minor area of said secondary wire from above at positions spaced from each other lengthwise of said wedge zone while leaving major areas of said wire runs unsupported and exposed to the spaces on the opposite surfaces thereof from said wedge zone and thereby causing liquid to be expressed through said unsupported and exposed areas into said spaces while avoiding the application of suction in said wedge zone to effect formation of a paper sheet between said wires in said wedge zone, and g. thereafter separating said top wire from said sheet on said primary wire.

14. The process defined in claim 13 wherein said stock has a consistency in the range of approximately 0.9 to 1.5% solids at the mouth of said wedge zone.

* * * * *